US006367115B1

(12) United States Patent
Frazier

(10) Patent No.: US 6,367,115 B1
(45) Date of Patent: Apr. 9, 2002

(54) WHITE BOARD ERASER

(76) Inventor: Thomas G. Frazier, c/o J. Penner Corp., 17 Weldon Dr., Doylestown, PA (US) 18901

( * ) Notice: Subject to any disclaimer, the term of this patent is extended or adjusted under 35 U.S.C. 154(b) by 0 days.

(21) Appl. No.: 09/668,274

(22) Filed: Sep. 25, 2000

(51) Int. Cl.[7] ..... A47L 13/44; A47L 13/29

(52) U.S. Cl. ..... 15/231; 15/104.92; 15/210.1; 451/538; D19/53

(58) Field of Search ..... 15/104.92, 209.1, 15/210.1, 231, 232; D19/53; 451/538

(56) References Cited

U.S. PATENT DOCUMENTS 1,822,856 A * 9/1931 Dirkes
2,529,163 A * 11/1950 Knight
2,739,334 A * 3/1956 Hardey
2,853,730 A * 9/1958 Belsky et al.
3,376,595 A * 4/1968 Cole
3,653,858 A * 4/1972 Field
3,784,998 A * 1/1974 Jones
4,437,271 A * 3/1984 McAvoy
4,937,910 A * 7/1990 Frazier
5,432,973 A * 7/1995 Wagner et al.
D398,644 S * 9/1998 Krapf
6,199,240 B1 * 3/2001 You
6,298,517 B1 * 10/2001 McKay

* cited by examiner

*Primary Examiner*—Terrence R. Till
(74) *Attorney, Agent, or Firm*—Zachary T. Wobensmith, III

(57) ABSTRACT

An eraser for removal of dry ink dust and for conditioning of white boards, which includes a stack of fabric layers which may be treated with cleaning and anti-static compounds. The fabric layers are of semi-rectangular shape which wrap around a jacket cover which is folded over a center core and joined together, the fabric layers have tab dispensing ends and other ends which are fastened to the cover and core by a single staple which spans the ends, the ends to permit the layers to be removed one at a time.

16 Claims, 2 Drawing Sheets

WHITE BOARD ERASER

BACKGROUND OF THE INVENTION

Field of the Invention

This invention relates to an eraser of the type which is designed to remove ink and condition white marker boards, and which has a plurality of layers of fabric which can be removed one at a time.

DESCRIPTION OF THE PRIOR ART

A white marker board (or light shades of tan) is generally a vertically mounted writing surface, that is written upon with felt-tipped pens, and that dispense a contrasting color ink that "dries" on the board. The writing is of a non-permanent ink which when "erased" becomes a loose dust that is removed from the board with the use of an eraser.

Typically, a white board was erased with a traditional felt type eraser, which was originally designed for use on black slate boards. The use of such a traditional felt (or foam type) eraser designed for slate blackboards, presents many problems for white board use. There are several reasons for the problems. A felt eraser is intended to remove white chalk dust from the porous surface of a slate board. Excess chalk dust, not held by an eraser, drops to the chalk tray, leaving the blackboard a dark shade of gray, but sufficiently dark to contrast with newly applied white chalk. The chalk dust drops from the board to the chalk tray, or is picked up by a clean felt eraser, since no static charges are generated during this procedure.

Additionally, the felt eraser re-fills pores in the slate board with chalk dust during the erasing operation, providing the user with a "chalked-in" board at all times. (Note that a brand new blackboard must be "chalked in" to prevent permanent "ghosts" that would occur if it were immediately written upon with chalk.)

A new white board, on the other hand, has a totally non-porous finish. The white board surface is normally porcelain, melamine, (resin finish) or plastic (polyester, etc.). Erasing marker dust from a white marker board using a "standard felt eraser" can and does cause static charges to build up through triboelectric forces, particularly on melamine and plastic surfaces. As the marker dust is not as dense as chalk dust, it does not drop off white boards, but has a tendency to adhere to the board's surface. This clinging problem is especially prevalent when static charges are generated. When the felt eraser becomes "saturated" with synthetic light, marker board ink dust, it redeposits, or pushes the dry ink to other portions of the white board. This condition makes the white board irregularly blotchy with dust, and very difficult to read, as well as unattractive.

A white board, after being subjected to the chemical solvents present in most of the marker pen inks and various types of chemical cleaners used to clean the board, gradually goes from a non-porous glazed surface (when new) to a more open porous surface. This condition is similar to a porcelain sink that has been scoured too often and from which the porcelain glaze has been removed. This treatment leads to a condition known in the industry as "ghosting". Ghosting occurs as marker pen ink flows down into the porous surface and dries. When a white board surface has been ghosted, only the top dust is removed when it is conventionally erased. The dried ink trapped below the surface remains there, creating "ghosts" of previous writings.

The ideal white board eraser should address the problems of ghosting caused by worn/porous white board surfaces.

Finally, the ideal white board eraser should be easy to use, easy to clean, capable of renewing its dust holding ability; and comfortable to hold. Ideally it should be sized no larger than a standard eraser (2"×5"×1.5" typically), as it must fit on the small trays provided on most white boards. Such an eraser ideally would be disposable after a life of 10–20 times that of a standard felt eraser, that was properly cleaned 10–20 times.

There have been many attempts to solve each of these concerns for the ideal eraser, but none of them has proven satisfactory by themselves and certainly not in concert with one another.

The Green U.S. Pat. No. 1,852,114 discloses a renewable surface dust cloth, that is composed of a plurality of thin, fibrous, loosely compacted layers.

While Green addresses the need for a "loose nap" material to increase dust holding capacity, the paper wadding structure disclosed is too weak to function as an eraser surface on a white board for any substantial time. While Green mentions impregnation of his dust cloth with an oil to increase its dust holding capacity, Green does not provide the convenience and hygienic factor of keeping the user's hand from touching a partially used surface, or one that contains an oil conditioner. Green provides no handle, no easy storage arrangement of holding, and then of discarding a layer of fabric after use, without handling the soiled layers.

The Harter U.S. Pat. No. 2,414,872, discloses a blackboard cleaner which includes a handle to which a laminated pad is mounted. The pad includes a number of plies or sheets of fabric that have been impregnated with a chemical to facilitate cleaning and prevent chalk dust.

The plies or sheets that make up the pad are vertically stitched to a tape, so that side portions of the sheets can be folded to bring surfaces of the plies to the front for use.

While Harter provides a more durable erasing surface, it would be necessary to clean the plies to obtain any reasonable economic life of the device. The Harter handle would not be satisfactory for white board use as it is cumbersome, and upon lifting, the soiled layers would likely revert to the original configuration and contact by the user would be necessary to expose a clean surface.

The Nebelung U.S. Pat. No. 1,587,670, discloses a device for polishing shoes and other articles, which includes a block carrying an endless band of fabric, the soiled surface of which must be handled to bring a fresh surface into use. The life of the Nebelung device is very limited, and requires excessive exposure of the soiled surface to the user's hands, as well as inconvenience due to the necessity of indexing or refilling the endless loop.

The Darling U.S. Pat. No. 2,648,863 discloses a blackboard eraser that is a hand held device, including a handle carrying a pad of material, but does not provide any structure to conveniently remove a soiled sheet of material without touching the soiled surface. Additionally, multiple layers (i.e., 10–20) of material could not be held by the holding tabs which Darling describes.

The Brouty U.S. Pat. No. 2,465,194, Walkama, U.S. Pat. No. 2,702,913, and Oviatt, U.S. Pat. No. 3,613,146, disclose various attempts to increase the dust holding or carrying capacity of a hand held device by providing a roll of material in the handle area. The use of a roll of material becomes unsatisfactory for white board eraser use when the bulk of such a device is considered.

The Bergquist U.S. Pat. No. 2,708,761, Walkama, U.S. Pat. No. 2,702,913 and Hensley, U.S. Pat. No. 2,693,610, disclose the use of adhesives to hold together adjacent layers of material. Adhesively held layers of material are susceptible to many shortcomings. The leading edges of the material tend to roll up due to friction, exposing the adhesive layer to the surface to be cleaned. Adhesive transferred to the board would reduce its use as a writing surface, and would also trap loose marker board dust. Renegade adhesive could also be retained on newly presented layers resulting in the described conditions.

Another commercially available white board eraser holds 25 replacement tissues, and is offered by Schwan Stabilo U.S.A., Inc. The used tissues are not easily disposed of as the user must handle the remaining stack of replacement tissues each time they are changed, which requires dismantling the eraser's components. If these tissues were to incorporate a conditioning and anti-static treatment (which they do not), handling them would be very messy and inconvenient, since to change a surface, the entire device must be "disassembled". This device lacks holding ability, as the spongy foam pad held by the handle fails to keep the fabric layer taut, so that the exposed fabric layer easily becomes loose, develops creases and folds during use. Schwan also requires that it be reloaded with replacement tissues to make it economical for use.

Other devices are shown in U.S. Pat. No. Hardey 2,739,334; Macullar U.S. Pat. No. 2,756,549; Scheur et al U.S. Pat. No. 2,870,475; George U.S. Pat. No. 3,199,136; and Cole U.S. Pat. No. 3,376,595, but none of them is satisfactory for white boards.

In my prior U.S. Pat. No. 4,937,910 a white board eraser is described which is quite satisfactory for its intended purpose, but which is more complicated to construct than is desirable, and which requires multiple efforts to remove the fabric layers.

The eraser of my invention is easier to manufacture, provides improved holding of the fabric layers, decreased effort to remove a layer to present a new one for use, and provides many other positive advantages over the prior art.

SUMMARY OF THE INVENTION

In accordance with the invention a white board eraser is provided for removal of ink dust and conditioning of white boards, which has a plurality of treated layers of fabric which are used to clean and condition a white board and which are removed one at a time to present a new layer for use.

The principal object of the invention is to provide a white board eraser of treated multi-layer fabric which has improved construction and easier removal of used layers.

A further object of the invention is to provide a white board eraser that is simple to construct but sturdy and reliable in use.

A further object of the invention is to provide a white board eraser which removes ink dust and conditions the surface of a white board.

A further object of the invention is to provide a white board eraser that provides a plurality of fabric layers that are easily removed one at a time to provide a new layer for use.

Other objects and advantageous features of the invention will be apparent from the description and claims.

BRIEF DESCRIPTIONS OF THE DRAWINGS

The nature and characteristic features of the invention will be more readily understood from the following description taken in connection with the accompanying drawings forming part hereof in which.

Figure 5:
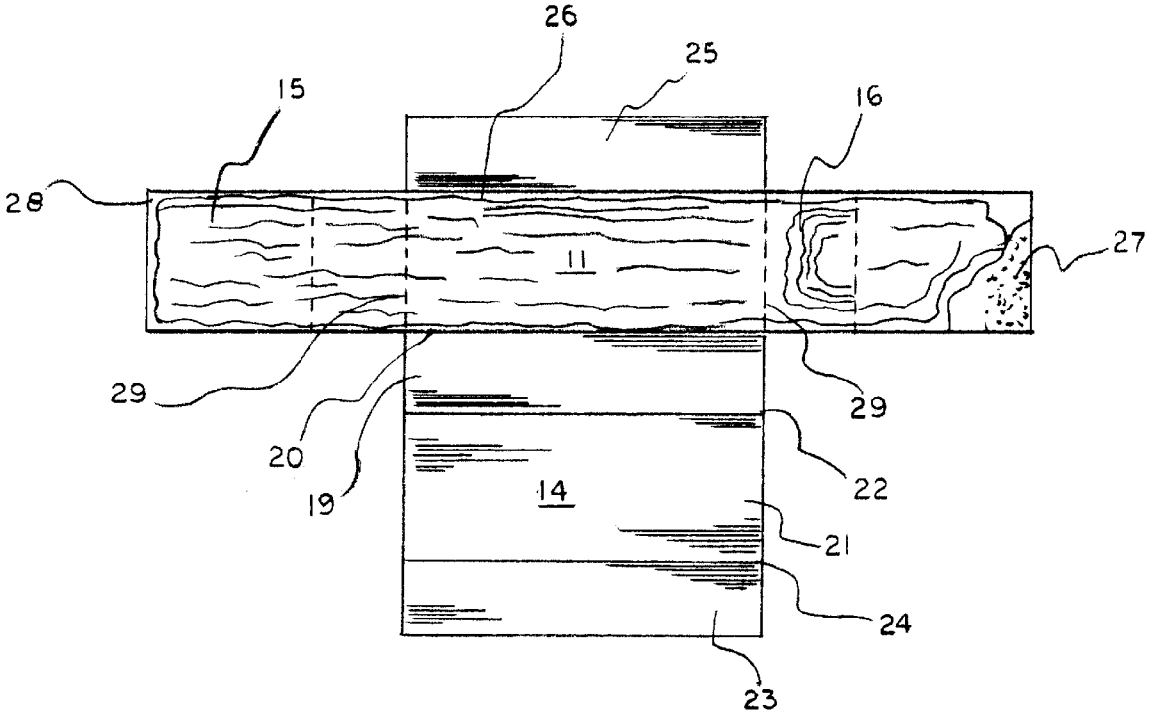
FIG. 5 is a bottom plan view of a partially assembled white board eraser of the invention.
Figure 1:
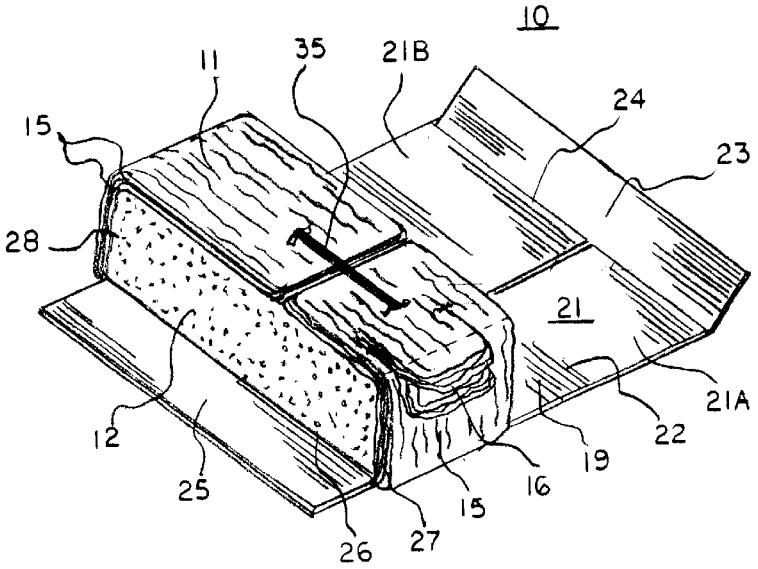
FIG. 1 is a perspective view of a partially assembled white board eraser of the invention.
Figure 2:
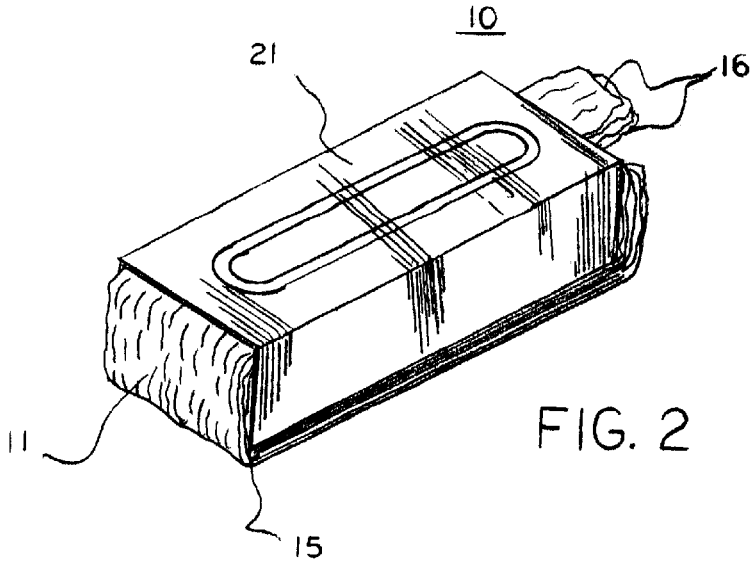
FIG. 2 is a perspective view of an assembled white board eraser.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Referring now more particularly to FIGS. 1–5 of the drawings a white board eraser 10 is shown which includes a multi-layered stack of fabric 11, a rigid foam core 12 and an outer cover 14.

The stack 11 is composed of a plurality of fabric layers 15, which are preferably die cut and may be of non-woven fabric. The fabric layers 15 has the following characteristics; a carded non-woven construction, with machine direction tensile strength exceeding cross machine direction tensile strength of a factor of 2 to 1 (typical minimum). The non-woven fabric layers 15 are print bonded in an "open" design, such as an array of binder dots or in a diamond pattern. The open pattern design allows for a higher dust capacity in the non-woven fabric, as the unbonded areas are 100% fiber. Since fibers hold dust; the more open the pattern, the higher the dust holding capacity of the fabric layer 15. Additionally, the non-woven fabric layers 15 are oriented with the machine direction of the fabric (or the direction with the higher tensile strength) in the same direction as the long axis of the eraser.

The fabric layer 15 should preferably be impregnated with a organosilicone fluid, such as Polyalkyleneoside modified polydimethylsiloxane, available from Union Carbide, to approximately 20% by weight of the base fabric. While mineral oil (or other dust holding additives not in the oil family) may be used, the use of an organosilicone fluid based additive achieves both increased dust holding ability, and anti-static properties. While other percentages can be used, it has been found that an additive level of 20±5% by weight achieves ideal conditions for the eraser fabric. The preferred fluid not only acts as a dust magnetic in the unbonded sections of the fabric, but in the case of organosilicone fluid, it additionally acts as an anti-static agent during the erasing procedure, which is especially true when used on a synthetic (melamine or polyester) white board surface.

The stack 11 of fabric layers 15 usually contains ten to twenty fabric layers 15, with a total thickness of approximately ¼ inch.

The layers 15 are die cut to provide a pull tab 16 on each layer which are exposed for use upon assembly of the eraser 10.

The outer cover 14 is a blank of semi-rectangular configuration with a center panel 18, a cover panel 19 connected to panel 18 along a scored fold line 20, a top cover panel 21 connected to panel 19 along a scored fold line 22, a side cover panel 23 is connected to panel 21 along scored fold line 24. A side cover panel 25 is connected to panel 18 along scored fold line 26, to which panel 23 may be secured by adhesive of well known type.

The top cover panel 21 has overlapping reinforcing panels 21A and 21B fastened thereto by adhesive of well known type.

The center panel 18 has overlapping end cover panels 27 and 28 connected thereto along scored fold lines 29 which panels are fastened together by adhesive of well known type.

The panels 18, 27 and 28 are pre-assembled around the foam core 12.

The fabric layers 15 are shingled or layered to provide uniform tension, and after wrapping around panels 19, 23, 25, 27 and 28, the tab ends 30 and other ends 31 are secured to the panels 27, 28 and core 12 by a large single staple 35, which spans the layer ends 30 and 31, and extends into the core 12.

The panels 18, 19, 21, 23, 25, 27 and 28 cover the core 12 in assembled condition.

The placement of staple 35 is in the center line of the fabric layers 15, which holds the layers taut, to provide a "wicket" type hold, and not a pressure or compression type hold.

Figure 3:
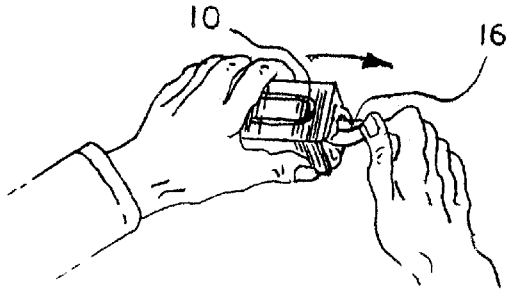
FIG. 3 is a schematic view of an eraser of the invention illustrating the first step in removing a layer of fabric to provide a new surface.
Figure 4:
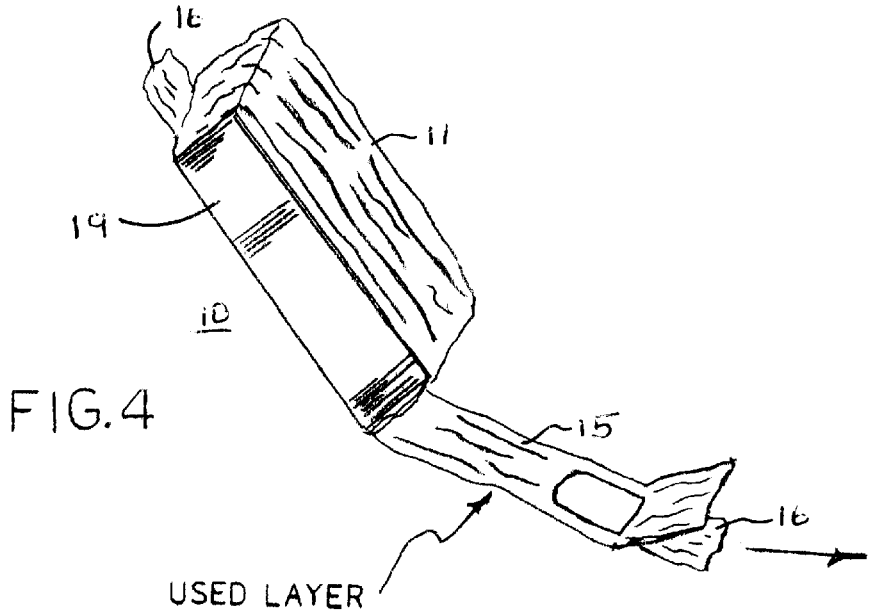
FIG. 4 is a view similar to FIG. 3 illustrating the final step to providing a new surface.

This feature permits the user as shown in FIGS. 3 and 4 to easily remove a used fabric layer 15 by pulling on a tab 16, which causes the tab end 30 to pull off from staple 35, and upon further pulling causes the other end to pull off the staple 35 exposing a new layer 15 of fabric for use.

By using a non-woven fabric with the described characteristics (MD tensiles greater than CD tensiles), the tab 16 will unzip the exposed layer 15 (See FIGS. 3 and 4) so that with a minimum of time and effort, the soiled top layer is removed by touching only the clean tab, and a small portion of the exposed layer 15 that is also clean. Thus a soiled layer 15 is easily and cleanly removed, exposing a new layer surface with a minimum amount of time and effort.

The outer cover 14 is intended to have an oil resistant fish of well known type, on the interior 41 of the printed cover 14, to prevent oil from migrating to the cover surface, and contaminating the user's hand with oil, or distorting the printed graphics on the product's cover. This can also be achieved by fabricating the cover of light weight, oil impervious, plastic sheeting, such as PVC, or Polypropylene.

It should be noted that other types of non-woven fabrics, such as bonded webs, binderless hydro-woven fabrics, needle punched non-woven fabric and even woven fabric having similar physical characteristics, with napped surfaces for dust holding capacity, may be used. The fabric must be structurally designed to allow the "zipper"effect of dispensing one layer at a time.

It should also be noted that the eraser 10 can be used for additional applications. With the proper selection of layered materials, e.g. sand paper, lens and mirror cleaning tissues or fabrics which can be impregnated with compounds for cleaning or polishing. The eraser device of the invention can be used as a "preloaded" sanding block, or as a glass cleaning device for cleaning computer screens or copier platens.

It will thus be apparent that erasers have been described with which the objects of the invention are achieved.

I claim:

1. An eraser for removal of dry ink from a white board surface which comprises, a stack having a plurality of fabric layers, an outer cover, a rigid central core about which said cover and said stack are wrapped, said fabric layers are elongated with tab ends and other ends, fastening means are provided to detachably fasten said tab ends and said other ends to said outer cover and said core, such that one layer at a time can be removed without disturbing the underlying layers, said fastening means is a staple which spans the layer ends and extends through said cover and into said core, and, each of said fabric layers has an exposed pull tab at said tab end for removal of one layer at a time from said stack.

2. An eraser as defined in claim 1 in which, said outer cover has a center panel, a cover panel connected to said center panel, a top cover panel connected to said center panel, a pair of side cover panels connected to said top cover panel, and, a pair of overlapping end cover panels connected to said center panel extending around said core and adhesively secured together.

3. An eraser as described in claim 1 wherein said fabric layers are treated with a material to improve dust holding ability.

4. An eraser as described in claim 1 wherein said cover is of chemical resistant material.

5. An eraser as described in claim 1 wherein said fabric layers are treated with an anti-static agent.

6. An eraser as described in claim 5 wherein said anti-static agent is an organisilicone fluid.

7. An eraser as described in claim 1 in which said layers of fabric are composed of biocomponent fibers that generate no static charges when subjected to triboelectric forces.

8. An eraser as described in claim 1 in which said layers of fabric are constructed of carded non-woven fabric.

9. An eraser as defined in claim 1 in which said layers of fabric are constructed of printed bonded non-woven fabric with the highest directional strength of the fabric in the longitudinal axis of the layers.

10. An eraser as described in claim 1 wherein said fabric layers are treated with mineral oil.

11. An eraser as described in claim 1 wherein the staple is clinched so that it does not compress or exert significant downward pressure on the fabric stack.

12. A device for providing layers of material for contact with a surface, one layer at a time which comprises, a stack having a plurality of layers of material, an outer cover, a rigid central core about which said cover and said stack are wrapped, said layers of material are elongated with tab ends and other ends, fastening means are provided to detachably fasten said tab ends and said other ends to said outer cover and said core, such that one layer at a time can be removed without disturbing the underlying layers, said fastening means is a staple which spans the layer ends and extends through said cover and into said core, and, each of said material layers has an exposed pull tab at said tab end for removal of one layer of material at a time from said stack.

13. A device as defined in claim 12 in which, said material layers are of sand paper.

14. A device as defined in claim 12 in which, said material layers are impregnated with a glass cleaning compound.

15. A device as defined in claim 12 in which, said material layers are impregnated with a polishing compound.

16. A device as defined in claim 12 in which, said material layers are impregnated with a cleaning compound.

* * * * *